350-333
3/14/78 XR 4,078,374

United States Patent [19]
Kondo

[11] 4,078,374
[45] Mar. 14, 1978

[54] ELECTRONIC TIMEPIECE

[75] Inventor: Kenichi Kondo, Tokyo, Japan

[73] Assignee: Kabushiki Kaisha Daini Seikosha, Japan

[21] Appl. No.: 649,635

[22] Filed: Jan. 16, 1976

[30] Foreign Application Priority Data

Jan. 16, 1975 Japan ..... 50-7215

[51] Int. Cl.[2] ..... G04B 19/30; G08B 23/00
[52] U.S. Cl. ..... 58/23 R; 58/50 R; 235/92 EA; 307/38; 340/324 M; 350/333
[58] Field of Search ..... 58/23 R, 23 BA, 50 R; 307/38, 270; 340/309.4, 321, 224, 336, 347 R, 347 DD; 350/160 LC

[56] References Cited

U.S. PATENT DOCUMENTS

| | | | |
|---|---|---|---|
| 3,781,863 | 12/1973 | Fujita | 58/50 R |
| 3,921,162 | 11/1975 | Fukai et al. | 340/336 |
| 3,936,676 | 2/1976 | Fujita | 340/336 |

*Primary Examiner*—Edith S. Jackmon
*Attorney, Agent, or Firm*—Robert E. Burns; Emmanuel J. Lobato; Bruce L. Adams

[57] ABSTRACT

An electronic timepiece including a plurality of counter circuits which together develop a count representative of time. A decoder circuit develops decimal signals representative of the counts developed by the respective counters, and a plurality of first switching circuits is operative to apply the respective counts developed by the respective counters in a timesharing mode. A plurality of second switching circuits, operating in synchronism with the first switching circuits, applies respective decimal signals, each corresponding to the count of a respective counter, to respective memory circuits for storage therein. The stored decimal signals are converted to serial binary signals by respective ones of a plurality of serial converting circuits, and the serial binary signals are applied to respective figure electrode driving circuits for developing figure electrode driving signals to drive figure electrodes of a display device having display elements each comprised of figure electrodes and separate segment electrodes. A segment electrode driving circuit intermittently drives the segment electrodes of the respective display elements in synchronism with the operation of the switching circuits to enable the respective display elements to display decimal figures corresponding to the contents of the respective counters and representative of time.

4 Claims, 11 Drawing Figures

FIG. 2
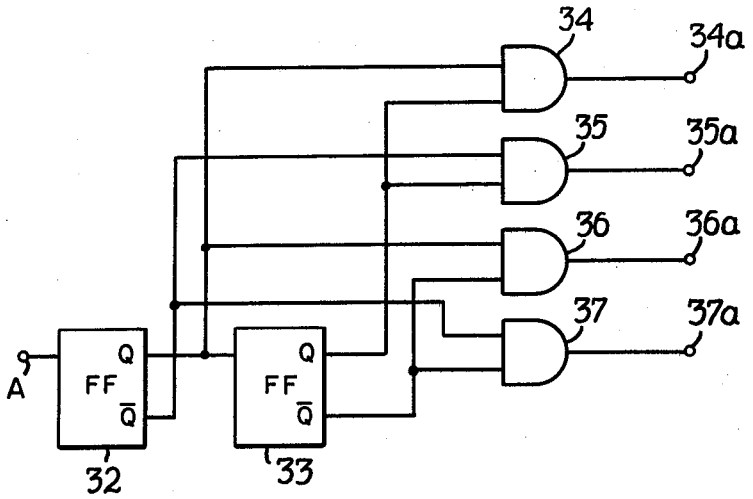
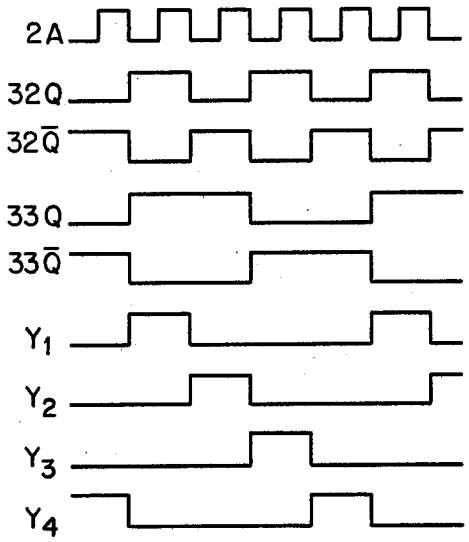
FIG. 3

FIG. 4
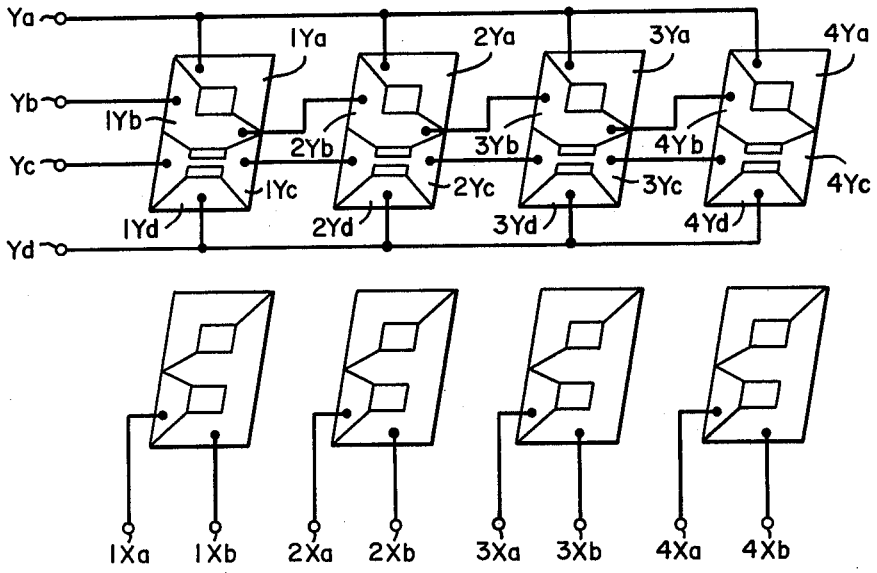
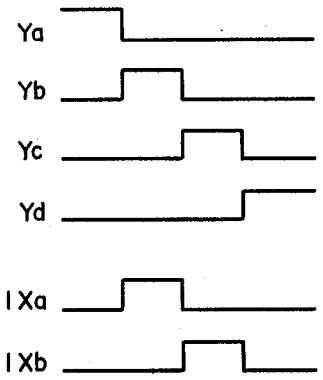
FIG. 5

ELECTRONIC TIMEPIECE

BACKGROUND OF THE INVENTION

This invention relates to an electronic timepiece, and particularly to an digital electronic timepiece having a display including a plurality of segment electrodes disposed in a matrix and two separated figure electrodes.

In digital electronic timepiece, the display elements of liquid crystal, LED and PLZT type are commonly employed. These display elements include a plurality of segment electrodes in a matrix for displaying the alphanumeric display and one figure electrode.

In the case of displaying a plurality of figures, each of the figure electrodes are sequentially scanned, and BCD code signals of counters corresponding to figure are applied to the decoder in a time sharing mode whereby changed segment signals are applied to the segment electrodes.

In the above noted conventional time display of said electronic timepiece, the duty ratio of the driving pulse becomes smaller with an increase of the number of the figures displayed whereby the display contrast is regraded, for the same reason, cross talk easily occurs in the multifigure display whereby the range of the display driving voltage which can be used becomes narrower, and the diaplay can only be used in a restricted temperature range.

In the case of commonly connected segment electrodes, an alphanumeric display has an irregular shape, and it is very difficult to read a displayed numeral and, further it is very difficult to commonly connect the segment electrodes whereby the yield rate becomes worse.

SUMMARY OF THE INVENTION

This invention aims to eliminate the above noted difficulty and insufficiency. The object of the present invention is to obtain a digital electronic timepiece having the following characteristics: a certain constant duty ratio of a multifigure display driving pulse, the driving operation carried out at the same voltage without the threshold of the display element depending on the duty ratio or duty cycle of the voltage relating to ease of connection with the segment electrodes, for a high yield ratio and connection can be made at the display without destroying the shape of the alphanumeric display element and easy reading of the alphanumeric display.

BRIEF DESCRIPTION OF THE DRAWINGS

FIG. 2 shows a detailed embodiment of the signal generating circuit in FIG. 1.

FIG. 3 shows a time chart for illustrating the operation of the signal generating circuit in FIG. 2.

FIG. 4 shows the structure of the display device illustrated in FIG. 1 having a segment electrode and figure electrode.

FIG. 5 shows the wave shape of the driving pulse applied to the segment and figure electrodes shown in FIG. 4.

DESCRIPTION OF THE PREFERRED EMBODIMENT

Figure 1:
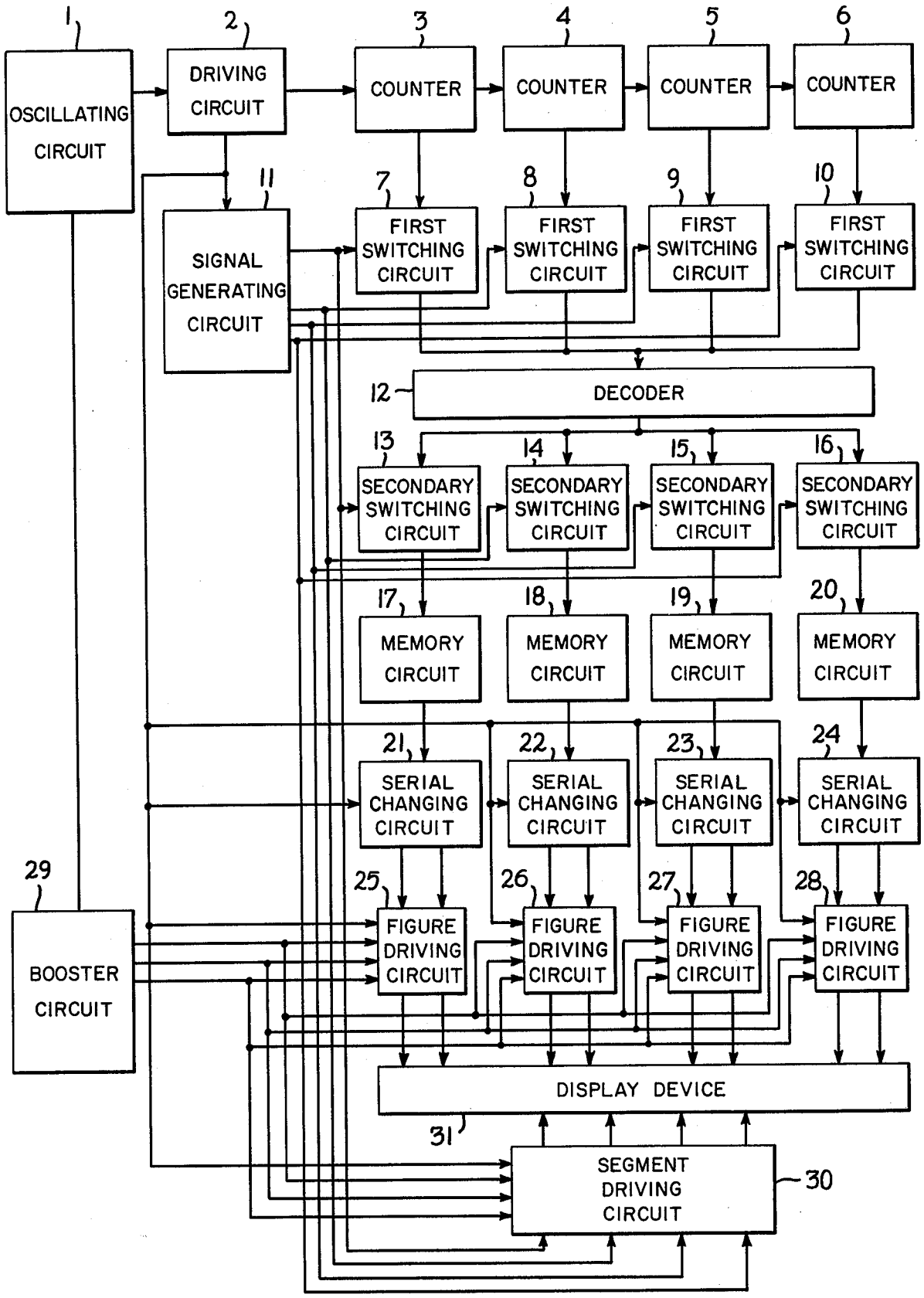
FIG. 1 shows one embodiment of the circuit of the present invention.

Referring now to the electrodic timepiece of the present invention illustrated in the accompanying drawings in which:

FIG. 1 shows one embodiment of the electronic timepiece of the present invention in which numeral 1 is an oscillating circuit having a crystal quartz element, and the oscillating circuit output signal frequency is divided to a certain frequency by the dividing circuit 2. The signal from said dividing circuit 2 is applied to the decimal counter 3.

The carry signal of said counter 3 is applied to the modulo six counter 4, the carry signal of said counter 4 is applied to the decimal counter 5, and the carry signal of said counter 5 is applied to the binary counter 6. Said counters 3 and 4 together comprise a modulo sixty counter which determine a value of the minute figures to be displayed, counters 5 and 6 together comprise a modulo twelve counter which operates to determine the value of the hour figure to be displayed.

The contents of said counters 3, 4, 5 and 6 are respectively applied to the first switching circuits 7, 8, 9 and 10.

Numeral 11 is a gate control signal generating circuit for sequentially generating four gate control signals in synchronism with the dividing circuit output signal having the certain frequency which is supplied by said dividing circuit, and said four gate control signals are applied to the control terminals of said first switching circuits 7, 8, 9 and 10. Therefore flow of the signals produced by said first counters 7 – 10 is sequentially controlled and, the contents of said counters 3 – 6 are generated from said first switching circuits 7 – 10 in a time sharing mode. Said counter contents (BCD code signal) of said counters 3 – 6 are sequentially applied to the decoder 12, and are changed to the decimal signal. The output signal of said decoder 12 is applied to the secondary switching circuits 13, 14, 15 and 16. The ON and OFF operations of said secondary switching circuits 13 – 16 are controlled in state of being synchronous to said first switching circuit 7 – 10 by the gate control signals from said signal generating circuit 11.

The output signals from said counters 3 – 6 are generated from said secondary switching circuits 13 – 16 via said first switching circuits 7 – 10 and the decoder 12, and are applied to the memory circuits 17, 18, 19 and 20. The cyclically applied decimal signal is stored in said memory circuits 17 – 20, and, said decimal signal is generated as an output signal until the next decimal signal is applied.

The decimal signal from said memory circuits 17 – 20 are applied to the serial changing circuits 21, 22, 23 and 24.

In said serial changing circuits 21 – 24, said decimal signal is changed to the serial binary signal which is synchronous with the dividing circuit output signal of said dividing circuit 2. Said serial binary signals developed by said serial changing circuits 21 – 24 are applied to the figure driving circuits 25, 26, 27 and 28 for driving the figure electrodes of the display elements in the display device 31. Said figure driving circuits 25 – 28 each applies the voltage of the booster circuit 29, which is a DC voltage of three levels, to said figure electrodes of said display device 31 according to said serial binary signal and in synchronism with the dividing signal of said dividing circuit 2.

The three output voltages of said booster circuit 29 are applied to the segment driving circuit 30 which applies said three voltages to the segment electrode of the display element in said display device 31 under control of the gate control signal from said signal generating circuit 11. In said display device 31, the numerals representing the time according to the contents of said counters 3 – 6 are displayed by the operations of said figure driving circuits 25 – 28 and said segment driving circuit 30.

Referring now to the detailed structure of the circuits illustrated in the accompanying drawings:

FIG. 2 shows the detailed embodiment of the control signal generating circuit 11 which comprises in combination: the T-type flip flop circuit 32 in which the input terminal is connected to the terminal A which receives the dividing signal obtained from the driving circuit 2, the flip flop circuit 33 in which the input terminal is connected to the output terminal Q of said flip flop circuit 32, the two input AND circuit 34 in which the input terminal is connected to the output terminals Q and Q of the flip flop circuits 32 and 33, the two inputs AND circuit 35 in which the input terminal is connected to the output terminals $\overline{Q}$ and Q of said flip flop circuits 32 and 33, the two inputs AND circuit 36 in which the input terminal is connected to the output terminals Q and $\overline{Q}$ of said flip flop circuits 32 and 33, and the two inputs AND circuit 37 in which the input terminal is connected to the output terminals $\overline{Q}$ and $\overline{Q}$ of said flip flop circuits 32 and 33.

Referring now to the operation of said signal generating circuit with reference to the accompanying time chart in FIG. 3:

When the dividing signal as indicated in the wave shape 2A was applied to the terminal A, the signals as indicated by the wave shape 32Q, 32$\overline{Q}$, 33Q and 33$\overline{Q}$ are generated from the output terminals Q and $\overline{Q}$ of said flip flop circuit 32 and 33. The gate control signals as indicated by the wave shape $y_1$, $y_2$, $y_3$ and $y_4$ are generated from the terminals 34*a* – 37*a* connected to the output side of the AND circuits 34 – 37 when signals indicated by the wave shape 32Q, 32$\overline{Q}$, 33Q and 33$\overline{Q}$ are applied to said AND circuits 34 – 37.

For example, said gate control signal $y_1$ is applied to the first switching circuit 7 and the secondary switching circuit 13 thereby controlling the ON and OFF condition of said switching circuits 7 and 13.

FIG. 4 shows the embodiment of the display device 31, especially showing the parallel four display digits having respectively four segment electrodes and two separated electrodes whereby the four figure alphanumeric displays are displayed.

The segment electrodes 1Y*a* – 4Y*a* correspond to the conventional electrodes *a* and *b*, the segment electrodes 1Y*b* – 4Y*b* correspond to the conventional electrodes *f* and *g*, the degment electrodes 1Y*c* – 4Y*c* correspond to the conventional electrodes *c* and *e*, further the segment electrodes 1Y*d* – 4Y*d* correspond to the conventional electrode *d*.

The conventional display element has only one figure electrode, however said electrode is separated to two pieces as indicated by 1X*a*, 1X*b*, 2X*b*, 3X*a*, 3X*b*, 4X*a* and 4X*a*. Said segment electrodes 1Y*a* – 4Y*a* are respectively and commonly connected to the terminal Y*a*, the segment electrodes 1Y*b* – 4Y*b*, 1Y*c* – 4Y*c* and 1Y*d* – 4Y*d* are respectively and commonly connected to the terminals Y*b*, Y*c* and Y*d*.

When displaying the numeral 2 at the first figure of said display device 31, the higher voltage is applied to the terminals Y*a* – Y*d* during T/4, the lower voltage is applied to the terminals Y*a* – Y*d* during 3/4T of the term T.

When the first terminal Y*a* is the higher voltage, the figure electrodes 1X*a* and 1X*b* are set to the lower voltage. When the terminal Y*b* is at the higher voltage, the figure electrode 1X*a* is set to the higher voltage, the figure electrode 1X*b* is set to the lower voltage.

Further, and when the terminal Y*c* is the higher voltage, the figure electrode 1X*a* is the lower voltage and the figure electrode 1X*b* is the higher voltage, when the terminal Y*d* is the higher voltage, the figure electrode 1X*a* is the lower voltage and the figure electrode 1X*b* is the lower voltage. These applied voltage wave shapes are indicated in FIG. 5.

Figure 6:
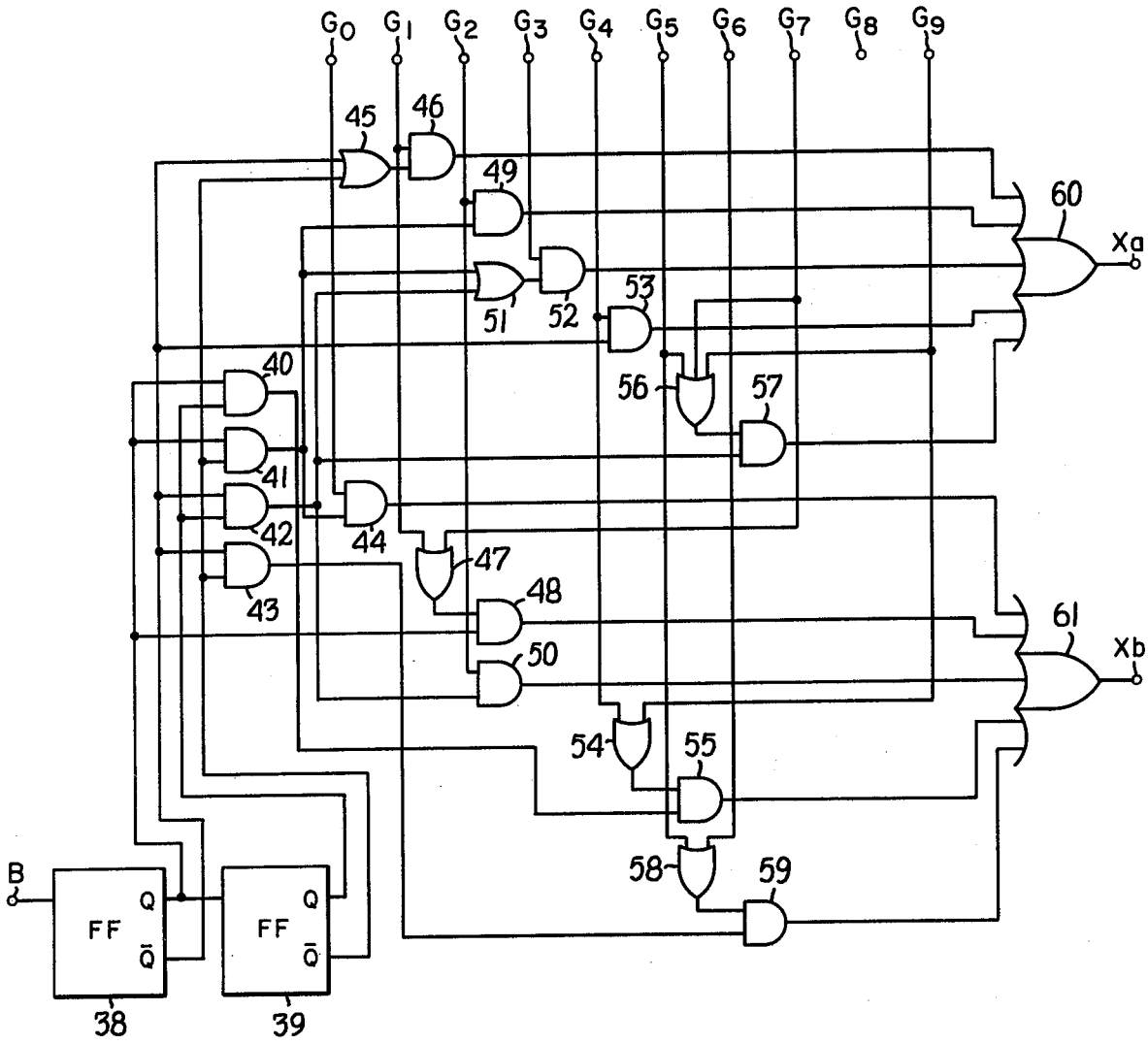
FIG. 6 shows the circuit of one embodiment of the serial changing circuit shown in FIG. 1.

FIG. 6 shows the serial changing circuits 21 – 24 for changing the decimal signal to the serial binary signal in order to obtain the voltages applied to the figure electrodes 1X*a* – 4X*a* and 1X*b* – 4X*b* for displaying the numerals 0 to 9.

In FIG. 6, the dividing signal of said dividing circuit 2 applied to said signal generating circuit 11 is applied to the terminal B. Said terminal B is connected to the input terminal of the T-type flip flop circuit 38, the output terminal Q of said flip flop circuit 38 is connected to the one input terminal of the two inputs AND circuits 40, 41 and 48 and the input terminal of the T-type flip flop circuit 39. The output terminal $\overline{Q}$ is connected to the one input terminal of the OR circuit 45 and the two inputs AND circuits 42, 43 and 53.

The output terminal Q of the flip-flop circuit 39 is connected to the AND circuits 40 and 42, and the output terminal $\overline{Q}$ is connected to the AND circuits 41 and 43 and the OR circuit 45.

The marks $G_0$ – $G_9$ are the terminals for receiving the decimal signal from the memory circuits 17-20 relating to the decoder 12. The terminal $G_0$ is connected to the other input terminal of the AND circuit 44 in which the output of the AND circuit 41 is applied to the one input terminal. The terminal $G_1$ is connected to the other input terminal of the AND circuit 46 in which the output of the OR circuit 45 is applied to the one input terminal, and is connected to the one input terminal of the OR circuit 47. The output of the OR circuit 47 is applied to the AND circuit 48. The terminal $G_2$ is connected to the other input terminal of the AND circuit 49 in which the output of the AND circuit 41 is applied to the one input terminal, and is connected to the other input terminal of the AND circuit 50 in which the output of the AND circuit 42 is applied to the one input terminal.

The terminal $G_4$ is connected to the other input terminal of the AND circuit 53 in which the output signal from the output terminal $\overline{Q}$ of the flip flop circuit 38 is applied to the one input terminal, and is connected to the one input terminal of the OR circuit 54. The output of said OR circuit 54 is applied to the other input terminal of the AND circuit 55 in which the output of said AND circuit 40 is applied to the one input terminal.

The terminal $G_5$ is connected to the one input terminal of the three inputs OR circuit 56, and is connected to the one input terminal of the two inputs of OR circuit 58. The output of the OR circuit 56 is applied to the AND circuit 57 together with the output of the AND circuit 42, the output of the OR circuit 58 is applied to the AND circuit 59 together with the output of the AND circuit 43. The terminal $G_6$ is connected to the other input terminal of said OR circuit 58, the terminal $G_7$ is connected to the one input terminal of the OR circuit 56 and the other input terminal of the OR circuit 47. The terminal $G_8$ is a free terminal without connection with any circuit. The terminal $G_9$ is connected to the remaining input terminal of the OR circuit 56 and the other input terminal of the OR circuit 54. The outputs of said AND circuits 46, 49, 52, 53 and 57 are respectively applied to the input terminals of the five inputs OR circuit 60, and the outputs of said AND circuits 44, 48, 50, 55, 59 are respectively applied to input terminals of the five inputs OR circuits 61. The serial binary signal composed of the output of the OR circuit 60 as the one signal and the output of the OR circuit 61 as the other signal is applied to the figure driving circuits 25, 26, 27 and 28 from the output terminals X*a* and X*b*.

At the above noted terminals $G_0 - G_9$ of the serial changing circuit, for example when displaying the numeral "2", a [1] signal is applied to the terminal $G_2$. Therefore, a [1] signal is applied to the terminal corresponding to the numeral being displayed, and a [0] signal is applied to the other terminals corresponding to numerals not being displayed.

Figure 7:
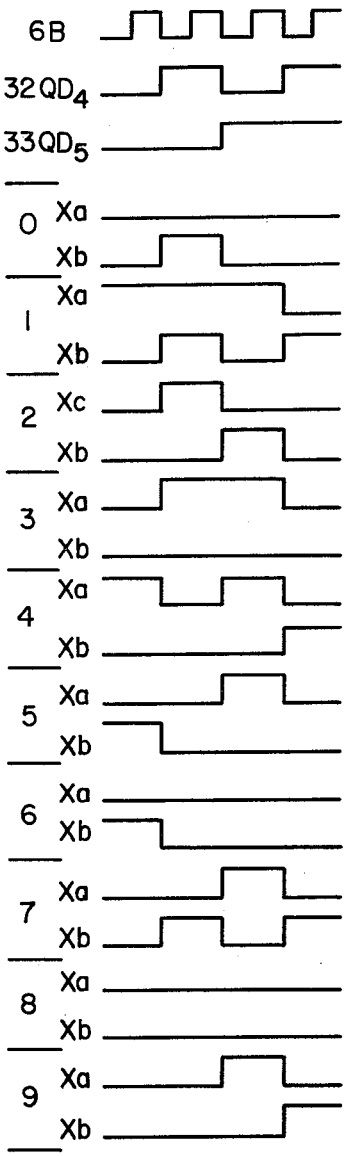
FIG. 7 shows a timing chart for illustrating the operation of the serial changing circuit in FIG. 6.

FIG. 7 shows the timing chart for indicating the operation of the serial changing circuit in FIG. 6, wherein the numerals 0 – 9 in FIG. 7 are the numerals to be displayed, and, [1] signals are respectively applied to the terminals $G_0 - G_9$ corresponding to said numerals. Numeral 6B is the wave shape of the dividing signal from the dividing circuit 2 applied to the terminal B. The numerals 32Q and 33Q are the output wave shape of the output terminals Q of the flip flop circuits 32 and 33, and the inverted wave shape signal is generated from the output terminal $\overline{Q}$. Marks X*a* and X*b* are the wave shape of the output signal generated from the output terminals X*a* and X*b*.

Figure 8:
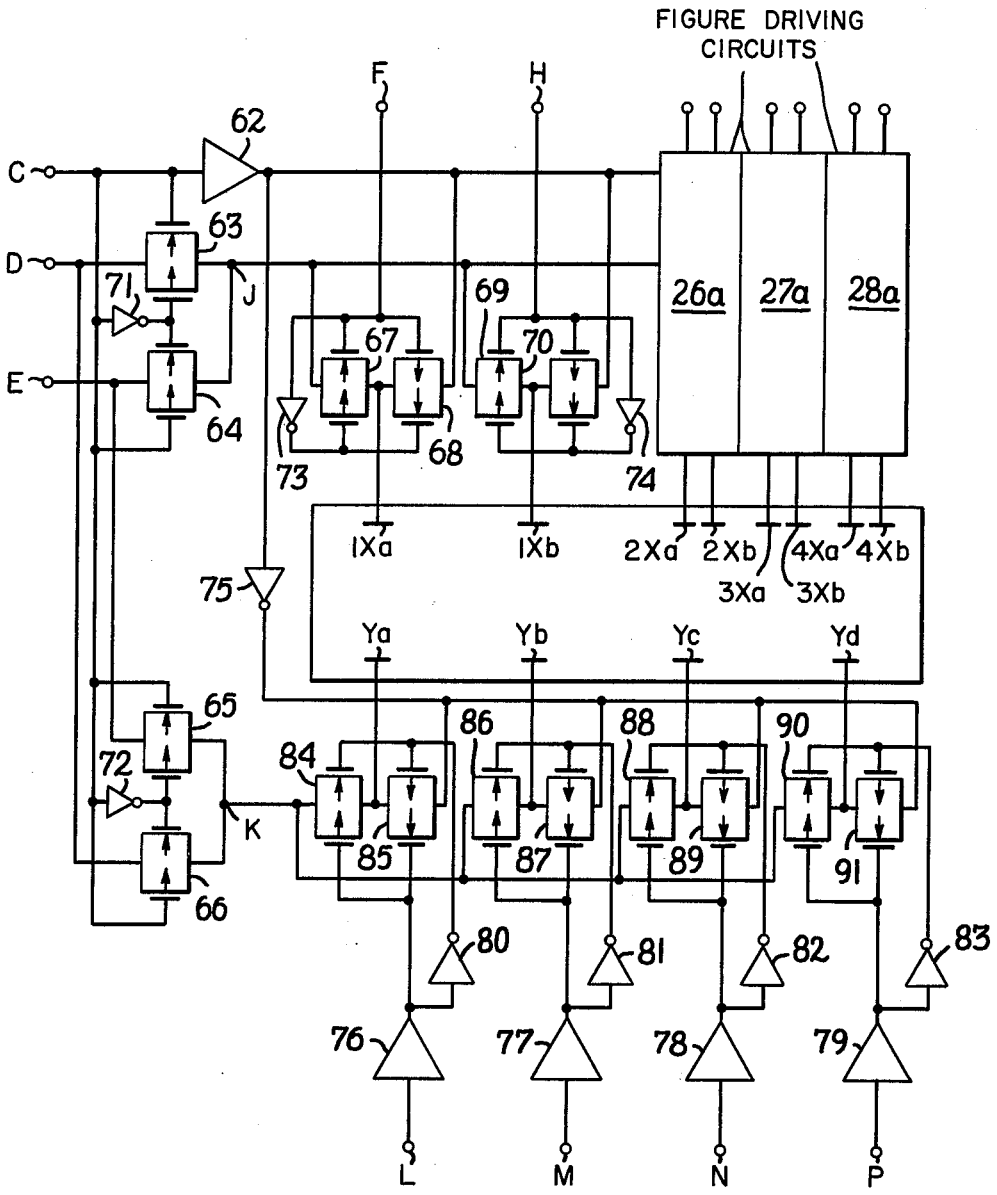
FIG. 8 shows the detailed circuitry of the figure and segment driving circuits shown in FIG. 1.

FIG. 8 shows the figure driving circuits 25 – 28 for driving the figure electrode of the display element according to the output signal of said serial changing circuits, and shows the segment driving circuit 30 for driving the segment electrodes according to the gate controlling signal from the signal generating circuit 11.

In FIG. 8, Mark C is the terminal in which the dividing signal of said dividing circuit 2 is applied and is the same as that applied to the terminal A in FIG. 2 and the terminal B in FIG. 6. Said terminal as indicated Mark "C" is connected to the input terminal of the amplifier 62 for setting the voltage level to 3 volts, and is connected to the one controlling terminal of the transmission gates 63, 64, 65 and 66 and the input terminal of the inverters 71 and 72. The output terminal of said inverters 71 and 72 are connected to the other controlling terminals of the transmission gates 63, 64, 65 and 66. A voltage of 1 volt is applied to the terminal D, and the terminal D is connected to the input terminal of the transmission gates 63 and 66. A voltage of 2 volts is applied to the terminal E which is connected to the input terminal of the transmission gates 64 and 65. The output terminals of the transmission gates 63 and 64 are commonly connected, and are connected to the input terminal of the transmission gates 67 and 69. The one terminal of the controlling terminals of the transmission gates 67 and 68 are commonly connected and connected to the terminal F. The serial signal generated from the output terminal X*a* in FIG. 6 is applied to the terminal F which is connected to the other controlling terminal of said transmission gates 67 and 68 via the inverter 73. The one terminals of said transmission gates 69 and 70 are commonly connected and connected to the terminal H. The signal generated from the output terminal X*b* in FIG. 6 is applied to the terminal "H" which is connected to the other controlling terminal of said transmission gates 69 and 70 via the inverter 74. The input terminals of said transmission gates 68 and 70 are connected to the output terminal of the amplifier 62 having 3 volts. The output terminals of the transmission gates 67 and 68 are commonly connected, and are connected to the figure electrode 1X*a* of the display element of the display device 31. The output terminals of the transmission gates 69 and 70 are commonly connected and are connected to the figure electrode 1X*b*.

The above noted description is about the detailed structure of the figure driving circuit 25 to which the output of the serial changing circuit 21 is applied, the other figure driving circuits 26, 27 and 28 are of the same construction, and are indicated as the blocks 26*a*, 27*a* and 28*a*.

Referring now to the operation of the figure driving circuit 25, the transmission gates 63 and 64 are switched by the dividing signal (wave shape 8C in FIG. 9) from the dividing circuit 2 via the terminal C, the repeated wave shape (wave shape 8J in FIG. 9) having 1 volt and 2 volts is obtained in the output point J. The transmission gates 67 and 68 are switched by the output signal (wave shape 6X*a* in FIG. 9) generated by the serial changing circuit 21. When the output signal is [1], the signal of the voltage level at said "J" point is applied to the figure electrode 1X*a*. When the output signal is [0], the repeated signal having 0 volt and 3 volts is applied to the figure electrode 1X*a*. The operation is the same for the transmission gates 69 and 70, for example when the output signal (wave shape 6X*b* in FIG. 9) of the serial changing circuit 21 is [1], the repeated signal having 2 volts and 1 volt is applied to the figure electrode 1X*b*. When the output signal (wave shape 6X*b* in FIG. 9) of the serial changing circuit 21 is [0], the repeated signal having 0 volt and 3 volts is applied to the figure electrode 1X*b*. The wave shapes of the driving signal applied to the figure electrodes 1X*a* and 1X*b* from said figure driving circuit 25 are indicated in FIG. 9 as the wave shapes 8X*a* and 8X*b*.

The segment driving circuit 30 is very similar in circuit construction, and the repeated signal having 1 volt and 2 volts (wave shape 8K in FIG. 9) is generated at the common output point K of the transmission gates 65 and 66. The terminals L, M, N and P are provided for receiving the four kinds of gate controlling signals generated from the signal generating circuit 11, the wave shapes of being applied to the terminals L, M, N and P are indicated as 8L, 8M, 8N and 8P in FIG. 9. The signal of 3 volts generated from said amplifier 62 is applied to the transmission gates 85, 87, 89 and 91 via the inverter 75. The signal applied to the terminal "L" is amplified to three volts by the amplifier 76, and is applied to the one control terminal of the transmission gates 84 and 85, and is inverted by the inverter 80, and then applied to the other controlling terminal. The signal of being applied to the terminal M is applied to the one controlling terminal of the transmission gates 86 and 87 via the amplifier 77, the output of the amplifier 77 is inverted by the inverter 81, and is applied to the other control terminal. The signal of being applied to the terminal N is amplified by the amplifier 78, and is applied to the one control terminal of the transmission gates 88 and 89, and is inverted by the inverter 82, and is applied to the other control terminal. The signal applied to the terminal P is applied to the control terminal of the transmission gates 90 and 91 via the amplifier 79, the output of the amplifier 79 is inverted by the inverter 83, and is applied to the other control terminal. The output of the transmission gates 65 and 66 applied to the output point K are applied to the input terminals of the transmission gates 84, 86, 88 and 90. The output terminals of the transmissin gates 84 and 85 are commonly connected, and are connected to the terminal Y*a* which is connected to the segment electrodes 1Y*a* – 4Y*a* of the display device. The output terminals of the transmission gates 86 and 87, the output terminals of said transmission gates 88 and 89 and the output terminals of the transmission gates 90 and 91 are respectively commonly connected, and are respectively connected to the terminals Y*b*, Y*c* and y*d* which in turn are connected to the segment electrodes in FIG. 4. The wave shapes of the output signal of the transmission gates 84 – 91 applied to the terminals Y*a*, Y*b*, y*c* and Y*d* are indicated as 8Y*a*, 8Y*b*, 8Y*c* and 8Y*d*.

Figure 9:
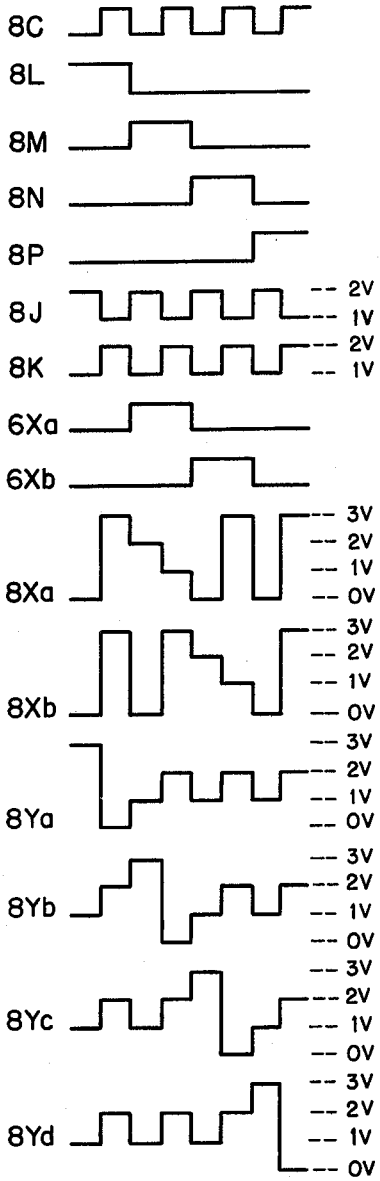
FIG. 9 shows a timing chart for illustrating the operation of the figure and segment driving circuits.

FIG. 9 shows the wave shape developed during the operations of the figure driving circuit and the segment driving circuit. When the signal [0] is applied to the terminal "L", the repeated signal having 1 volt and 2 volts is generated to the terminal Y*a*. When the signal [1] is applied to the terminal "L", the repeated signal having 3 volts and 0 volts is generated to the terminal Y*a*. Therefore, the liquid crystal display is operated by the voltage balance between the figure electrode and the segment electrode. The alternating voltage of 1 volt is usually applied to the liquid crystal display device according to the natural characteristics of said liquid crystal display device. The wave shapes 8J, 8*K*, 6X*a*, 6X*b*, 8Y*a*, 8Y*b*, 8Y*c* and 8Y*d* in FIG. 9 are employed for displaying numeral "2".

In the above noted embodiment, the number the figure displays is four whereby the duty ratio of the driving pulse is set to one-fourth, said duty ratio of one-fourth is usually maintained as the number of figures becomes greater. Therefore, it is possible to obtain constant contrast.

Figure 10:
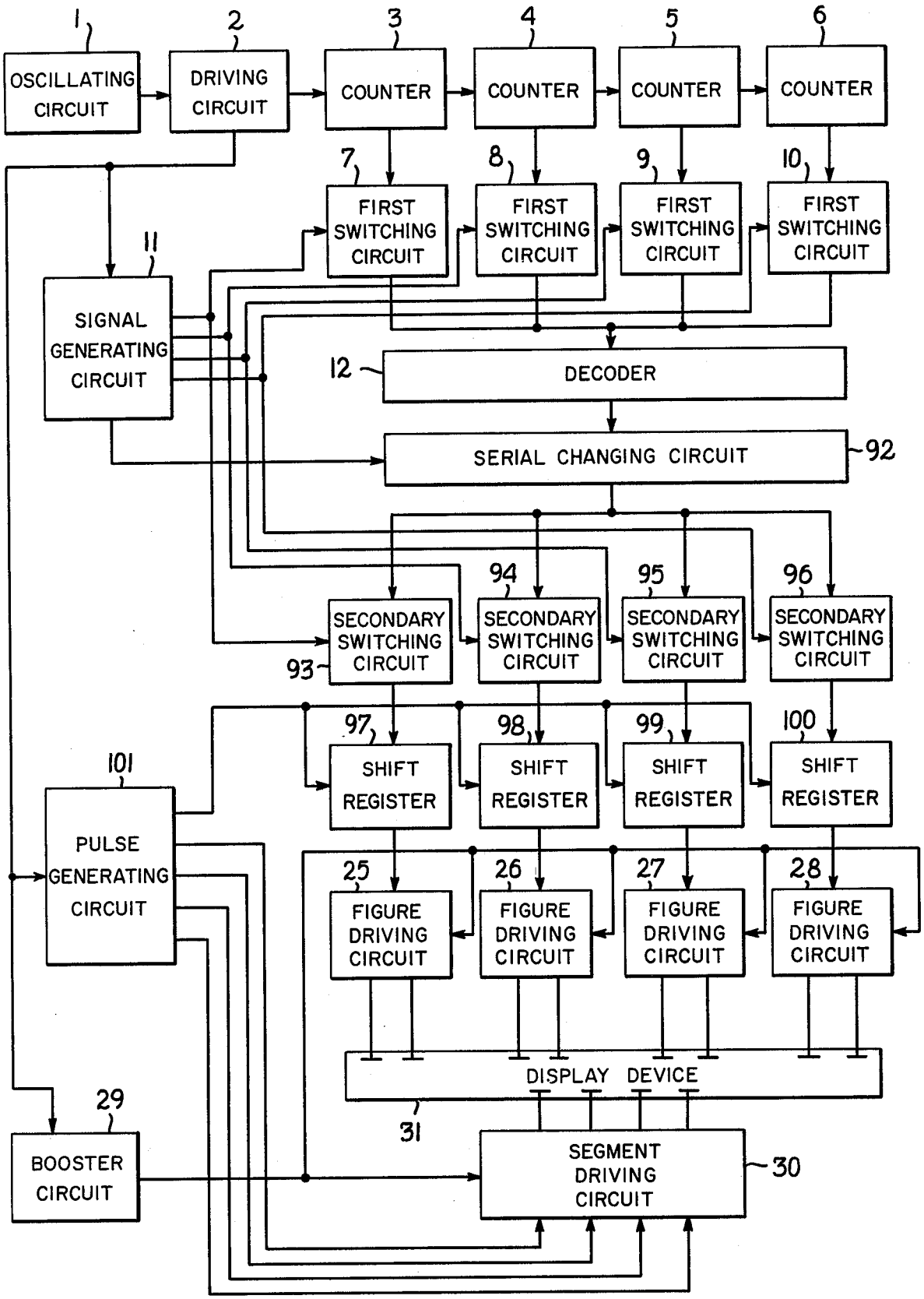
FIG. 10 shows the circuit of a second embodiment of the present invention.

FIG. 10 shows the other embodiment of the present invention, the same numerals are employed in FIG. 10 for the same circuit components as illustrated in FIG. 1 – FIG. 9.

The counting contents generated with the BCD code signal of the counters 3, 4, 5 and 6 are sequentially applied to the decoder 12 via the first switching circuits 7, 8, 9 and 10 switched by the four gate controlling signals sequentially generated from the signal generating circuit 11, and are changed to the decimal signal format by the decoder 12. The output of the decoder 12 is applied to the serial changing circuit 92. Said decimal signal is changed to the serial binary signal format by the serial changing circuit 92. Said serial binary signal is the signal which changes every quarter at the operating time T when one of the first switching circuits 7 – 10 is set, and is synchronous with the signal from the signal generating circuit 11. The serial binary signal generated from the serial changing circuit 92 is applied to the secondary switching circuits 93, 94, 95 and 96 at only said T time. Four kinds of the gate controlling signals from the signal generating circuit 11 are respectively applied to said secondary switching circuits 93, 94, 95 and 96, said secondary switching circuits are synchronously operated with respective ones of said first switching circuits 7 – 10 at only said T time, and said serial binary signal passes said secondary switching circuits 93, 94, 95 and 96 during the operating time of said secondary switching circuits. The serial binary signal is applied to the four bits shift registers 97, 98, 99 and 100 corresponding to the counters 3 to 6. Said four bits shift registers 97 to 100 generates the one bit of said serial binary signal once within a time under control of the clock pulse from the pulse generating circuit 101 for generating the clock pulse of the term T according to the dividing signal generated from the dividing circuit 2. The signals generated from the shift registers 97 to 100 are applied to the figure driving circuits 25, 26, 27 and 28. The voltages having a plurality of levels from the booster circuit 29 are applied to the figure driving circuits 25 to 28. Said figure driving circuits 25 to 28 select the voltages from said booster circuit 29 according to the output signals from said four bits shift registers 97 to 100, and apply the voltages from said booster circuit 29 to the figure electrode of the display element of said display device 31. On the other hand, the voltage having a plurality of levels from said booster circuit 29 is applied to the segment driving circuit 30. The pulse generating circuit 101 generates the pulse controlling signal having a period of 5T and a pulse width T, and applies said pulse controlling signal to the segment driving circuit 30. Said segment driving circuit 30 selects three voltage levels under the control of said pulse controlling signal, and applies the selected voltage signal to the segment electrode of the display element of the display device 31. Therefore, a certain voltage is applied to the same segment electrode of the display element corresponding to each figures only during and internal T for each period of 5T, and, the time of displaying the one numeral is set to 4T. The serial binary signal corresponding to the counting contents of the counters 3 to 6 is applied to the shift register 97 to 100 in the remaining time T.

In the embodiment of FIG. 10, the duty ratio of the driving pulse of the display element is constant without regard to the number of figures, so it is possible to obtain the good contrast.

Figure 11:
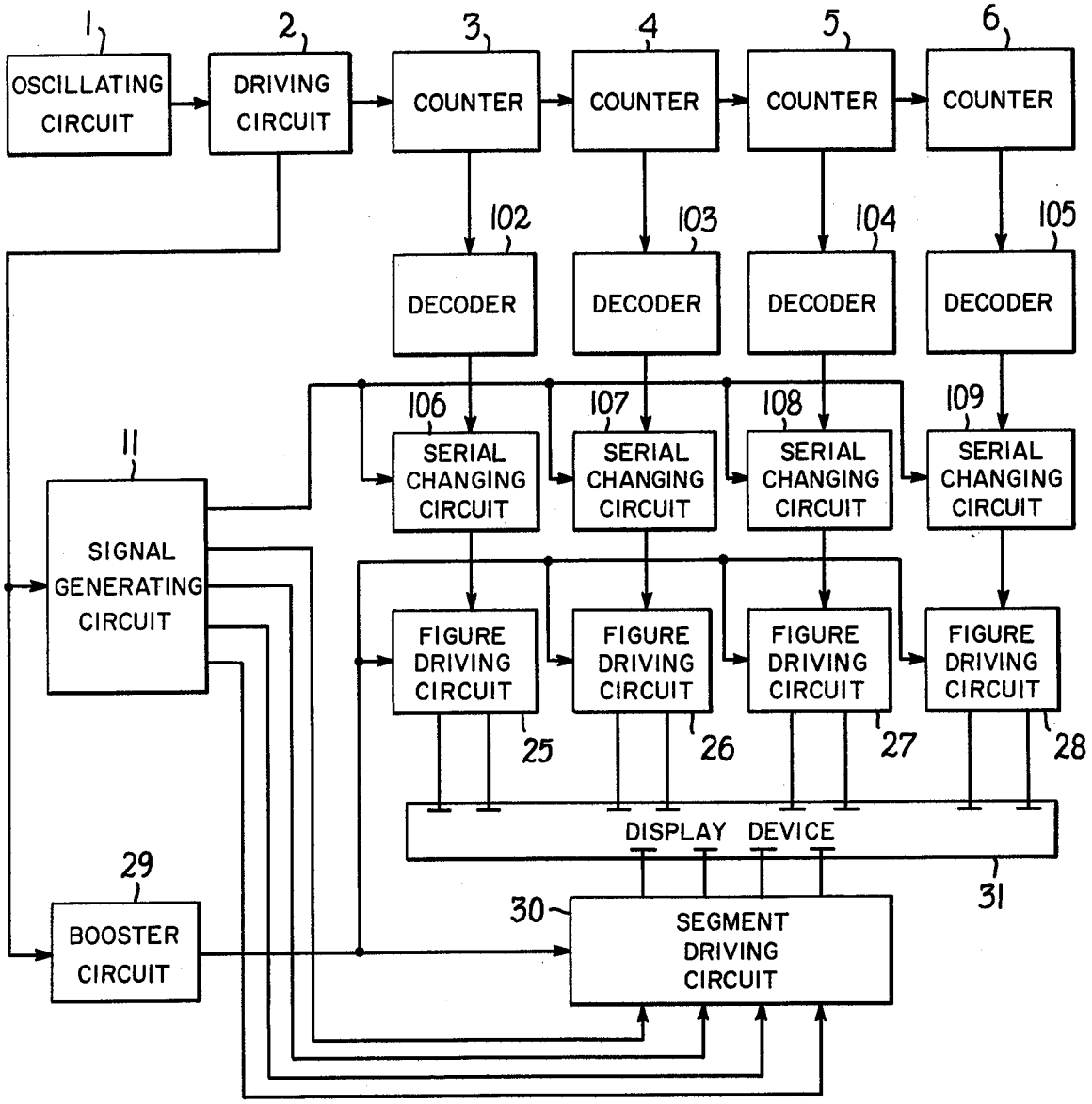
FIG. 11 shows the circuit of a third embodiment of the present invention.

FIG. 11 shows the other embodiment of the present invention, wherein the same reference numerals are employed in FIG. 11 asin the circuits illustrated in FIG. 1 to FIG. 10 for designating the same circuit components.

The counting contents of the BCD signal of the counters 3, 4, 5 and 6 is applied to the decoders 102, 103, 104 and 105, and is changed to the decimal signal. The decimal signal corresponding to the counting contents of the counters 3 to 6 generated from the decoders 102 to 105 is applied to the serial changing circuits 106, 107, 108 and 109 controlled by the one signal of the five controlling signals having a period T generated from the signal generating circuit 11. Therefore, the decimal signals from the decoders 102, 103, 104 and 105 are changed to the serial binary signal in the serial changing circuits 106 to 109, and a serial binary signal is applied to the figure driving circuits 25, 26, 27 and 28. The voltage having three levels from the booster circuit 29 is applied to the figure driving circuits 25 to 28 and the segment driving circuit 30. Said figure driving circuits 25 to 28 select the voltage of the three levels applied from the booster circuit 29 according to the serial binary signal having the period T, and applies said voltage of three levels to the figure electrode of the display element of the display device 31. The gate controlling signal is applied to the segment driving circuit 30 from the signal generating circuit 11. The segment driving circuit 30 selects the voltage of three levels applied from said booster circuit 29 according to said gate controlling signal. Then said segment driving circuit 30 applies the selected voltage to the four separated segment electrode of the display element of the display device 31 only during an interval of T/4, and operates the display driving of the term T.

In the embodiment of FIG. 11, the duty ratio of the driving pulse of the display element is independent of the number of figures, so it is possible to obtain a good contrast.

According to the present invention, the segment electrodes corresponding to a plurality of display element for displaying the time are simultaneously sequentially scanned whereby the duty ratio of the driving pulse of the display element is kept constant, so it is possible to obtain a good contrast without regard to the number of display figures. It is possible to obtain a constant threshold voltage in any time. It is also possible to drive the display device in the same voltage.

I claim:

1. An electronic timepiece comprising, in combination:

an oscillator circuit for developing an oscillatory output signal having a certain frequency;

a dividing circuit receptive of the oscillatory output signal for developing an output signal having a frequency equal to a standard rate of advance of time;

a plurality of counter circuits receptive of the dividing circuit output signal for together developing a total count representative of time which advances at the standard rate in response to the dividing circuit output signal;

a decoder circuit for developing decimal signals representative of the count developed by respective ones of said plurality of counters;

a plurality of first switching circuits each corresponding to a respective one of said counter circuits and being responsive to control signals for applying the respective counts developed by the respective ones of said counter circuits to said decoder circuit;

control signal generating means for applying control signals to said plurality of first switching circuits effective to operate said first switching circuits to apply the respective counts developed by said counter circuits to said decoder circuit in a time-sharing mode;

a plurality of memory circuits each corresponding to a respective one of said counter circuits;

a plurality of second switching circuits each corresponding to a respective one of said counter circuits and being responsive to said control signals for applying respective decimal signals corresponding to the counts developed by respective ones of said counters to respective ones of said memory circuits for storage therein;

a plurality of serial converting circuits each corresponding to a respective one of said counters for converting the decimal signal stored in a respective one of said memory circuits into a serial binary signal;

a display device having a plurality of alphanumeric display elements each corresponding to a respective one of said counter circuits and each comprised of segment electrodes and two separate figure electrodes;

a plurality of figure electrode driving circuits each corresponding to a respective one of said counters and each connected to receive a respective serial binary signal developed by a respective serial converting circuit for developing figure electrode driving voltage signals having a certain level in synchronism with the respective serial binary signals and for applying the figure electrode signals to the figure electrodes of the respective display elements; and a segment electrode driving circuit for intermittently driving the segment electrodes of the respective display elements in synchronism with the operation of said switching circuits to enable the respective display elements to display decimal figures corresponding to the counts of the respective counters and representative of time.

2. An electronic timepiece according to claim 1, wherein said control signal generating means generates control signals comprising a plurality of pulse trains in synchronism with the output signal of said dividing circuit and having a same pulse repetition rate and relative phases such that pulses of different ones of said pulse trains occur successively in time.

3. An electronic timepiece according to claim 2, wherein said control signal generating means comprises a plurality of AND gates each corresponding to a respective one of said plurality of pulse trains for developing the corresponding pulse train as an output thereof; a plurality of flip-flops connected in cascade including a first flip-flop receptive in use of the output signal of said dividing circuit and which together develop pulse trains in synchronism with and having a lower frequency than the output signal of said divider circuit; and circuit means applying the pulse trains developed by respective ones of said flip-flops to corresponding inputs of said AND gates for enabling said AND gates to develop said pulse trains in synchronism with the output signal of said dividing circuit.

4. An electronic timepiece according to claim 1, wherein each of said serial converting circuits comprises, a pair of OR gates which develop a pair of serial binary figure electrode signals together defining a unique digit; a pair of flip-flops connected in cascade and including a first flip-flop receptive of the output signal of said dividing circuit and which together develop pulse trains in synchronism with and having a lower frequency than the output signal of said divider circuit; a plurality of input terminals for receiving respective input signals respectively corresponding to unique decimal digits; said means comprising a plurality of gates responsive to the pulse trains developed by said flip-flops and to said input signals for enabling said OR gates to develop the pair of serial binary figure electrode signals in synchronism with the output signal of said divider circuit.

* * * * *